US007909136B2

(12) United States Patent
Surace et al.

(10) Patent No.: US 7,909,136 B2
(45) Date of Patent: Mar. 22, 2011

(54) SOUNDPROOF ASSEMBLY

(75) Inventors: Kevin J. Surace, Sunnyvale, CA (US); Matthew V. Golden, San Francisco, CA (US); Brandon D. Tinianov, San Jose, CA (US)

(73) Assignee: Serious Materials, Inc., Sunnyvale, CA (US)

( * ) Notice: Subject to any disclaimer, the term of this patent is extended or adjusted under 35 U.S.C. 154(b) by 998 days.

(21) Appl. No.: 10/996,509

(22) Filed: Nov. 24, 2004

(65) Prior Publication Data

US 2006/0108175 A1 May 25, 2006

(51) Int. Cl.
*E04B 1/82* (2006.01)

(52) U.S. Cl. ..... 181/290; 181/284; 52/144; 52/145

(58) Field of Classification Search ..... 181/290, 181/284; 52/145, 144
See application file for complete search history.

(56) References Cited

U.S. PATENT DOCUMENTS

| | | | | | |
|---|---|---|---|---|---|
| 1,807,395 | A | * | 5/1931 | Ellis | 52/405.4 |
| 1,925,453 | A | * | 9/1933 | Mazer | 181/290 |
| 2,079,878 | A | * | 5/1937 | Sabine | 52/204.593 |
| 2,177,393 | A | * | 10/1939 | Johns | 52/145 |
| 2,872,710 | A | * | 2/1959 | Cox | 52/407.3 |
| 3,111,787 | A | * | 11/1963 | Chamberlain | 52/309.9 |
| 3,215,225 | A | * | 11/1965 | Kirschner | 181/290 |
| 3,305,993 | A | * | 2/1967 | Nelsson | 52/481.1 |
| 3,319,738 | A | * | 5/1967 | Wehe, Jr. | 181/290 |
| 3,462,899 | A | * | 8/1969 | Sherman | 52/309.6 |
| 3,642,511 | A | | 2/1972 | Cohn et al. | |
| 3,828,504 | A | | 8/1974 | Egerborg et al. | |
| 4,073,093 | A | * | 2/1978 | Ookawa et al. | 49/381 |
| 4,375,516 | A | | 3/1983 | Barrall | |
| 4,487,291 | A | * | 12/1984 | Walker | 181/290 |
| 4,548,854 | A | * | 10/1985 | Wach | 428/138 |
| 4,571,915 | A | * | 2/1986 | Barman | 52/784.11 |
| 4,663,224 | A | | 5/1987 | Tabata et al. | |
| 4,956,321 | A | | 9/1990 | Barrall | |
| 5,026,593 | A | * | 6/1991 | O'Brien | 428/215 |
| 5,063,098 | A | * | 11/1991 | Niwa et al. | 428/76 |
| 5,210,984 | A | * | 5/1993 | Eckel | 52/79.5 |
| 5,256,223 | A | | 10/1993 | Alberts et al. | |
| 5,342,465 | A | | 8/1994 | Bronowicki et al. | |
| 5,416,285 | A | * | 5/1995 | Niehaus | 181/287 |

(Continued)

FOREIGN PATENT DOCUMENTS

CA 2219785 10/1996

(Continued)

OTHER PUBLICATIONS

Noisekiller product description Jul. 2, 2003.*

(Continued)

*Primary Examiner* — Elvin G Enad
*Assistant Examiner* — Forrest M Phillips
(74) *Attorney, Agent, or Firm* — Haynes and Boone, LLP

(57) ABSTRACT

A soundproof assembly having front and rear panels with one or both of the front and rear panels having a laminar structure. In one embodiment the front and rear panels are spaced apart by a spacer structure and a covering structure is attached around the periphery to provide an enclosed air space between the front and rear panels. In another embodiment the front and rear panels are affixed to each other. In another embodiment front and rear panels are separated by an interior panel.

24 Claims, 13 Drawing Sheets

U.S. PATENT DOCUMENTS

| | | | | |
|---|---|---|---|---|
| 5,473,122 | A | 12/1995 | Kodiyalam et al. | |
| 5,474,840 | A * | 12/1995 | Landin | 428/450 |
| 5,691,037 | A | 11/1997 | McCutcheon et al. | |
| 6,123,171 | A | 9/2000 | McNett et al. | |
| 6,173,534 | B1 * | 1/2001 | Dupin | 49/501 |
| 6,177,180 | B1 * | 1/2001 | Bodine et al. | 428/223 |
| 6,182,407 | B1 * | 2/2001 | Turpin et al. | 52/232 |
| 6,266,936 | B1 * | 7/2001 | Gelin | 52/481.1 |
| 6,286,280 | B1 * | 9/2001 | Fahmy et al. | 52/408 |
| 6,342,284 | B1 | 1/2002 | Yu | |
| 6,381,196 | B1 | 4/2002 | Hein et al. | |
| 6,533,877 | B1 | 3/2003 | Davisson et al. | |
| 6,632,550 | B1 | 10/2003 | Yu et al. | |
| 6,800,161 | B2 | 10/2004 | Takigawa | |
| 6,803,110 | B2 * | 10/2004 | Drees et al. | 428/423.7 |
| 6,815,049 | B2 | 11/2004 | Veramasuneni | |
| 6,822,033 | B2 | 11/2004 | Yu | |
| 7,041,377 | B2 | 5/2006 | Miura et al. | |
| 7,181,891 | B2 * | 2/2007 | Surace et al. | 52/642 |
| 7,216,464 | B2 * | 5/2007 | Neal et al. | 52/584.1 |
| 2003/0066707 | A1 * | 4/2003 | Quam et al. | 181/287 |
| 2003/0114064 | A1 * | 6/2003 | Fu et al. | 442/239 |
| 2003/0192279 | A1 * | 10/2003 | Hughart | 52/481.1 |
| 2004/0177590 | A1 * | 9/2004 | Nudo et al. | 52/783.1 |

FOREIGN PATENT DOCUMENTS

| | | |
|---|---|---|
| JP | 09-203153 | 8/1997 |
| WO | WO 96/34261 | 10/1996 |
| WO | WO 97/19033 | 5/1997 |
| WO | WO 00/24690 | 5/2000 |

OTHER PUBLICATIONS

Vandersall , H. L., "*Intumescent Coating Systems, Their development and Chemistry*" J. Fire & Flammability, vol. 2 (Apr. 1971) pp. 97-140 (45 pages).

English Language Abstract, JP Patent First Publication No. 09-203153, Aug. 5, 1997, (2 pages).

*A Study of Techniques to Increase the Sound of Insulation of Building Elements*, Wyle Laboratories, Prepared for Dept. of Housing and Urban Development, Jun. 1973 (16 pages).

*Field Sound Insulation Evaluation of Load-Beating Sandwich Panels for Housing*, Final Report, Prepared by Robert E. Jones, Forest Products Laboratory, Forest Service, U.S. Department of Agriculture, Aug. 1975 (53 pages).

*Sound Studio Construction on a Budget*, F. Alton Everest, McGraw-Hill, 1997 (7 pages).

*Wood Handbook/Wood as an Engineering Material*, United States Department of Agriculture, Forest Service, General Technical Report FPL-GTR-113, Mar. 1999 (24 pages).

*Transmission Loss of Plasterboard Walls* by T. D. Northwood, Building Research Note, Division of Building Research, National Research Counsel, Ottawa, Canada (10 pages).

*A Guide to Airborne, Impact, and Structureborne Noise Control in Multifamily Dwellings*, U. S. Department of Housing and Urban Development, Prepared for the National Bureau of Standards, Washington, D. C., Jan. 1963 (5 pages).

*Transmission Loss of Leaded Building Materials*, Paul B. Ostergaard, Richmond L. Cardinell, and Lewis S. Goodfriend, The Journal of the Acoustical Society of America, vol. 35, No. 6, Jun. 1963 (7 pages).

*Dictionary of Architecture & Construction 2200 illustrations*, Third Edition, Edited by Cyril M. Harris, Professor Emeritus of Architecture Columbia University, McGraw-Hill, 2000 (7 pages).

*Dictionary of Engineering Materials*, Harald Keller, Uwe Erb, Wiley-Interscience by John Wiley & Sons, Inc. 2004 (4 pages).

*Chamber Science and Technology Dictionary*, by Professor Peter M. B. Walker, W & R Chambers Ltd and Cambridge University Press, 1988 (3 pages).

A. Jagota et al., "Stress in Metal Foils During Processing and Thermal Cycling", Materials Research Society Symposium Proceedings, 226, 197-202, (1991).

Aluminium Foil Product Listing, http://www.alibaba.com/product-as/267937999/Aluminium_Foil_Aluminum_Strip_5657_H24.html, retrieved on Apr. 27, 2010.

Z. Xie et al., "An enhanced beam model for constrained layer damping and a parameter study of damping contribution", Journal of Sound and Vibration, vol. 319, Issues 3-5, pp. 1271-1284, Jan. 23, 2009.

* cited by examiner

SOUNDPROOF ASSEMBLY

CROSS REFERENCE TO RELATED APPLICATION(S)

This application is related to commonly assigned U.S. patent application Ser. No. 10/658,814 filed Sep. 8, 2003, by Kevin J. Surace and Marc U. Porat, entitled "Accoustical Sound Proofing Material and Methods for Manufacturing Same", and U.S. patent application Ser. No. 10/938,051 filed Sep. 10, 2004, by Kevin J. Surace and Marc U. Porat, entitled "Acoustical Sound Proofing Material and Methods for Manufacturing Same," both of which are incorporated by reference herein in their entirety.

FIELD OF THE INVENTION

This invention relates to an acoustical damping structure which may be utilized for doors, floors, walls and ceilings to prevent the transmission of sounds from one area to another.

BACKGROUND OF THE INVENTION

Soundproof doors or sound transmission resistant doors have been around for a number of years and have typically been constructed of wood or metal in order to achieve or reduce sound transmission. Although sound transmission through the structure has been reduced, the doors have been rather bulky and heavy. An issue with these doors is how to make them with a high Sound Transmission Class (STC) rating and at the same time avoid the mass requirement of the prior art doors. In the prior art providing an increased STC over standard doors has been achieved by using heavy doors in order to prevent the transmission of acoustic energy from one side of the door to the other. Typical prior art soundproof doors have been made of solid, heavy materials to prevent sound transmission. Typical current soundproof doors have a mass of from about eight to ten pounds per square foot, which can result in a door weighing from three hundred to five hundred pounds, and in some cases as much as one thousand pounds. This significant amount of weight adds stress to the associated structure and in addition is not desirable for household use in view of the significant weight involved. A typical household door of a non-soundproof construction has an STC rating of about twenty-seven as opposed to the prior art, unitary soundproof doors which typically have an STC rating in the forties.

Thus what is required is a soundproof structure which has improved STC ratings, but avoids the heavy weight which has been typical of prior soundproof doors.

SUMMARY OF THE INVENTION

The present invention provides a soundproof assembly which has significantly reduced weight, yet provides an STC rating equivalent to solid doors having twice the weight. In accordance with the invention, a soundproof assembly is provided which includes one or more laminar structures which are, in one embodiment, separated by an air gap and in another embodiment separated by a layer of material. In one embodiment, both a front and a rear panel of the structure are laminar, while in another embodiment, one of the front or rear panels is laminated and the other is solid.

In one embodiment, the laminar structure includes interiorly, a constraining layer, with the constraining layer having one or more layers of viscoelastic glue on opposite sides. First and second exterior layers of material, are provided on opposite sides of the viscoelastic glue. The exterior layers may be cellulose or wood based, ceramic, metal or a composite material.

In constructing the soundproof assembly, the front and rear portions may be separated by spacers to provide an air gap intermediate the front and rear sections.

In another embodiment, a wood surround is provided about the peripheral edges of the soundproof structure. Additionally, for appearance purposes a veneer may be provided. The veneer merely serves a cosmetic function and it is not necessary for the achievement of improved STC characteristics of the soundproof structure.

In a further embodiment of the present invention, a method of forming a soundproof assembly is provided. In this method, a first panel having a laminar structure is supported adjacent to a second panel with the first and second panels being spaced apart by one or more spacers to provide an air gap between the adjacent surfaces of the first and second panels.

In a second embodiment, both the first and second panels have a laminar structure.

In providing a panel having a laminar structure, the laminar structure is produced by providing a first layer of material which is cellulose or wood based, applying one or more layers of viscoelastic glue to a surface of the first layer of cellulose material, providing a constraining layer of material, and placing this constraining layer of material on the exposed surface of the viscoelastic glue. Next, one or more layers of viscoelastic glue are provided on the exposed surface of the constraining layer and a second layer of material which is cellulose or wood based is placed on the viscoelastic glue which is exposed on the constraining layer of material. Alternative materials for the first and second layers of material include ceramic, metal, or a composite material. In one embodiment, the constraining layer of material is a layer of metal and in other embodiments, the constraining layer of material may be a solid petroleum-based synthetic material such as vinyl, plastic composite, rubber, ceramic, a composite material or any other material that has a Young's Modulus of 10 GigaPascals (GPa) or greater.

In another embodiment, the laminar structure is constructed by utilizing three layers of material which are cellulose or wood based and two layers of a constraining material interior of and intermediate the three layers of cellulose or wood based material. The constraining layers have a viscoelastic glue layer interposed between each of them and the adjacent layer of cellulose material. In the embodiment which includes two constraining layers and three cellulose layers, both of the constraining layers may be formed of a metal, a solid petroleum based synthetic material such as vinyl, plastic composites, rubber, ceramic composite, or another material having a high Young's Modulus above 10 GigaPascals (GPa). Alternatively one of the constraining layers may be one of the foregoing materials and the other may be another of the foregoing materials.

DETAILED DESCRIPTION OF THE EMBODIMENT(S)

Figure 1:
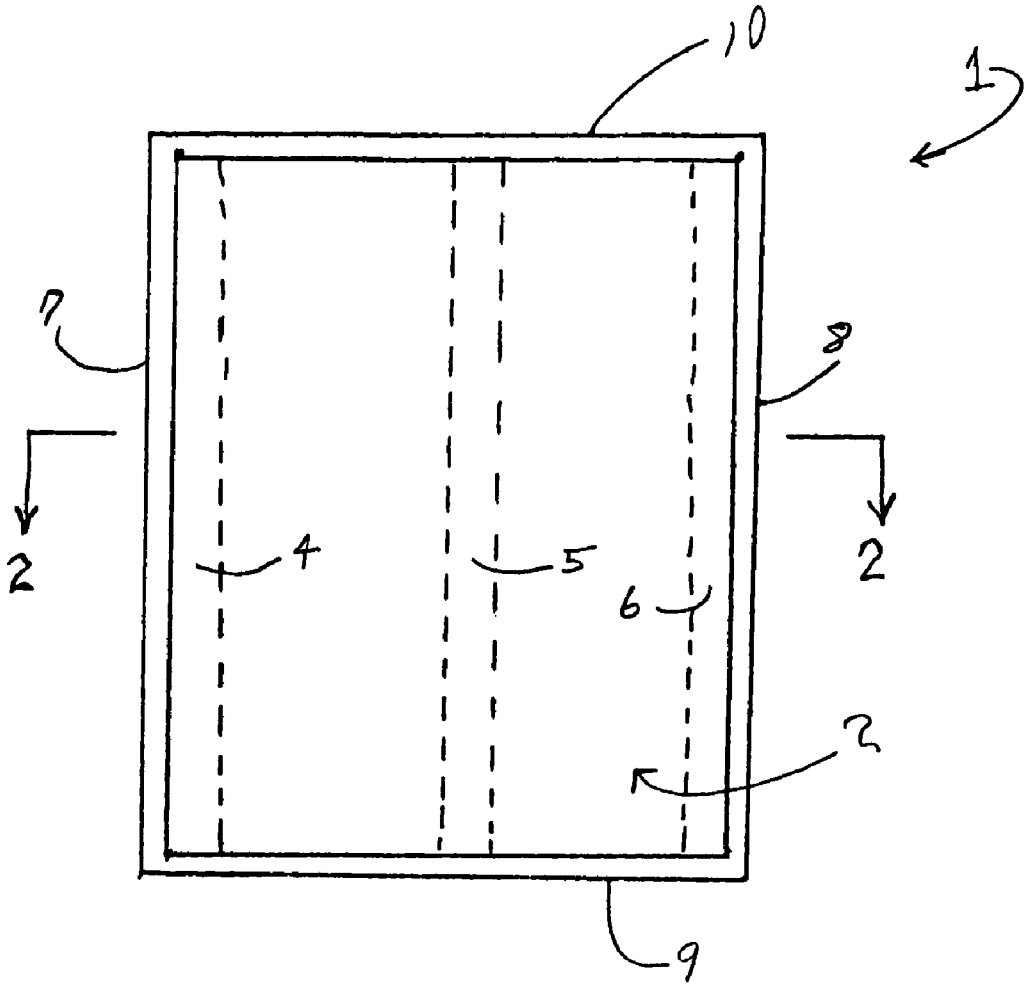
FIG. 1 is a front view of one embodiment of a soundproof assembly in accordance with the invention.
Figure 2:
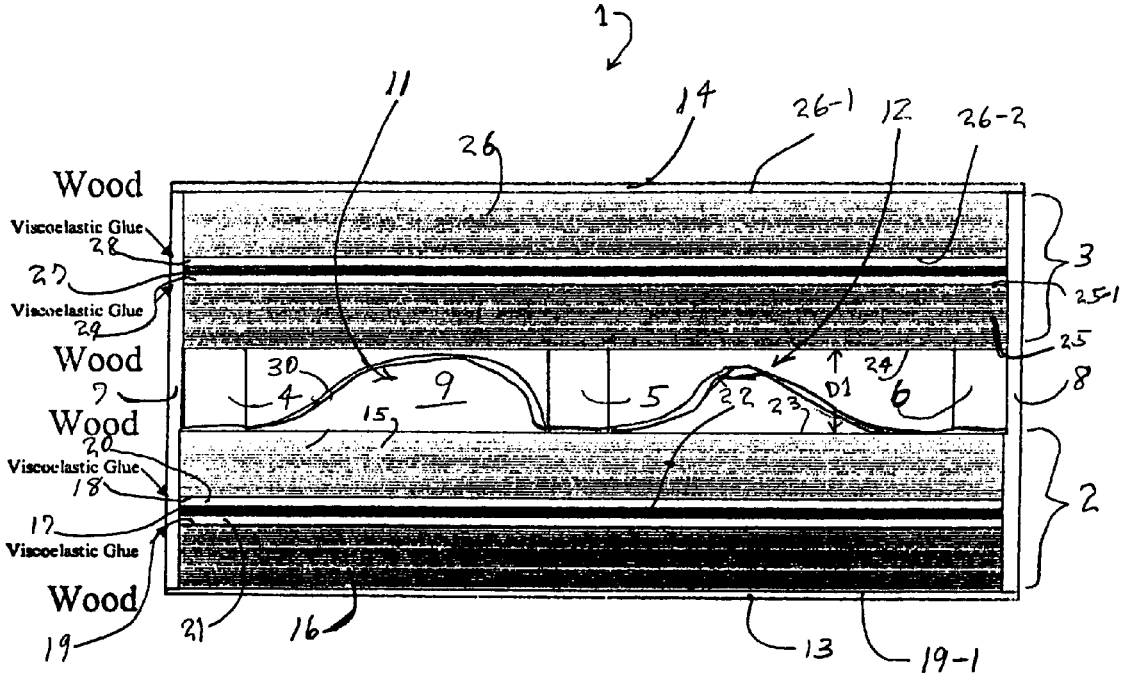
FIG. 2 is a cross-section taken along the lines of 2-2 of FIG. 1.

FIG. 1 is a front view of soundproof assembly 1 which includes a front panel 2 and a rear panel 3 which is best illustrated in FIG. 2. Rear panel 3 is connected to front panel 1 via spacers 4, 5, and 6, which are illustrated in FIG. 1 in dotted line outline and shown in the top view in FIG. 2. As will be appreciated by reference to FIG. 2, front panel 2 and rear panel 3 are symmetrical in construction, the details of which are described below. Spacers 4, 5, and 6, hold front panel 2 and rear panel 3 in a spaced apart relationship to provide an air gap between the panels.

As will be appreciated by reference to FIG. 2, the opposing edges of front panel 2 and rear panel 3 have a cover layer of material indicated by reference characters 7 and 8 which close the opposite edges of the panels. The bottom edges of soundproof assembly 1 are also enclosed by a cover indicated by reference character 9 in FIGS. 1 and 2, and similarly a top cover layer 10 encloses the upper portion of soundproof assembly 1. This accordingly provides an enclosed air space within soundproof assembly 1. In the embodiment illustrated in FIGS. 1 and 2, the use of three spacers 4, 5, and 6 results in the air gap enclosure indicated by reference characters 11 and 12 in FIG. 2. In one embodiment acoustically absorptive material such as fiberglass, cellulose, mineral wool, or foam is included in the air gap enclosures 11 and 12. The embodiment illustrated in FIGS. 1 and 2 includes veneer 13 on the front panel 2 and veneer 14 on the rear panel 3 for aesthetic purposes. The use of veneers 13 and 14 is not necessary to provide the structure of the present invention, however they may be useful, if for example, the soundproof assembly will be used as a door or other structure where an attractive appearance is desirable.

In the embodiment illustrated in FIG. 2, the front panel and rear panels are constructed alike. It is of course not required that the two panels be alike in order to practice the invention; however in this embodiment that is the case. In the alternative embodiment illustrated in FIGS. 3 and 4, the two panels are dissimilar in construction. FIG. 5 illustrates an alternative construction for laminar panels, which may be used in practicing the present invention.

Returning to FIG. 2, front panel 2 is comprised of a laminar combination of layers of materials including external layers 15 and 16. Layers 15 and 16 in one embodiment are cellulose, or wood based layers. In one embodiment of the invention, layers 15 and 16 are ¼ inch thick plywood; however other thicknesses may of course be utilized depending on the desired characteristics of the weight and sound transmission reduction to be achieved. Alternatively, layers 15 and/or 16 could be ceramic, metal, or a composite material which includes a fiber such as fiberglass, Kevlar or carbon fiber. As used herein, the term composite material means a material which includes two or more materials combined in such a way that the individual materials are distinguishable.

Intermediate the interior surfaces 18 and 19 of layers 15 and 16 respectively, are a first layer of viscoelastic glue 20 and a second layer of viscoelastic glue 21. Intermediate glue layers 20 and 21 is a constraining layer indicated by reference character 17. This construction, as will be appreciated by reference to FIG. 2, provides a laminar structure.

Constraining layer 17 is, in one embodiment, a layer of metal, which may be for example 30 gauge, galvanized steel. It will of course be appreciated that other thicknesses may be used as well as other materials such as sheets of ultra-light weight titanium and laminated layers of metal including laminate of aluminum and titanium. If galvanized steel is utilized, it should be non-oiled and of regular spackle. The non-oil characteristic is required to ensure that the viscoelastic glue layers 20 and 21 will adhere to the metal. Regular spackle ensures that the metal has uniform properties over its entire area. Constraining layer 17 is constructed of a metal; typical ranges of thicknesses are from 10 gauge to 30 gauge depending on the weight, thickness, and STC desired. Of importance, the constraining layer 17 should not be creased because creasing will ruin the ability of the metal to assist in reducing the transmission of sound. Only completely flat, undamaged pieces of metal can be used in the laminar structure. Constraining layer 17 may alternatively be a layer of ceramic material, or a layer of composite materials, such as, for example, fiberglass, Kevlar or carbon fiber.

Constraining layer 17 may be alternatively mass loaded vinyl or a similar material. A suitable mass-loaded vinyl may be purchased from Technifoam in Minneapolis, Minn., and have a thickness of ⅛ of an inch; however, other thicknesses may of course be used.

As will be appreciated by reference to FIG. 2, viscoelastic glue is applied on opposite sides of constraining layer 17. This viscoelastic glue has the property that the energy in the sound and vibrations which strikes the glue, when constrained by surrounding layers, will be significantly absorbed by the glue thereby reducing the sound and vibration's amplitude across a broad frequency spectrum, and thus reducing the energy of sound transmitted through the resulting laminar structure. Typically, this glue is made of materials as set forth in Table 1, although other glues having the characteristics set forth directly below Table 1 can also be used in this invention.

Quiet Glue ™ Chemical Makeup

| | WEIGHT % | |
|---|---|---|
| Components | Min | Max |
| Acetaldehyde | 0.00001% | 0.00010% |
| acrylate polymer | 33.00000% | 65.00000% |
| Acrylonitrile | 0.00001% | 0.00100% |
| Ammonia | 0.00100% | 0.01000% |
| bis(1-hydroxy-2-pyridinethionato) Zinc | 0.01000% | 0.10000% |
| Butyl acrylate | 0.00100% | 0.10000% |
| butyl acrylate, methyl methacrylate, styrene, methacrylic acid 2-hydroxyethyl acrylate polymer | 5.00000% | 15.00000% |

-continued

| Quiet Glue ™ Chemical Makeup | | |
|---|---|---|
| | WEIGHT % | |
| Components | Min | Max |
| CI Pigment Yellow 14 | 0.01000% | 0.02000% |
| Ethyl acrylate | 0.00001% | 0.00010% |
| ethyl acrylate, methacrylic acid, polymer with ethyl-2-propenoate | 1.00000% | 5.00000% |
| Formaldehyde | 0.00100% | 0.01000% |
| Hydrophobic silica | 0.00100% | 0.01000% |
| paraffin oil | 0.10000% | 1.00000% |
| polymeric dispersant | 0.00100% | 0.01000% |
| potassium tripolyphosphate | 0.00000% | 0.00200% |
| silicon dioxide | 0.00100% | 0.10000% |
| sodium carbonate | 0.01000% | 0.10000% |
| stearic acid, aluminum salt | 0.00100% | 0.10000% |
| Surfactant | 0.00100% | 0.10000% |
| Vinyl acetate | 0.10000% | 1.00000% |
| Water | 25.00000% | 40.00000% |
| zinc compound | 0.00100% | 0.10000% |

The physical solid-state characteristics of QuietGlue include:

1) a broad glass transition temperature which starts below room temperature;

2) mechanical response typical of a rubber (i.e., high elongation at break, low elastic modulus);

3) strong peel strength at room temperature;

4) weak shear strength at room temperature;

5) swell in organic solvents (e.g., Tetrahydrofuran, Methanol);

6) does not dissolve in water (swells poorly);

7) peels off the substrate easily at temperature of dry ice.

In constructing front panel 2, viscoelastic glue layer 21 is applied to interior surface 19 of layer 16. Various thicknesses of glue may be utilized and can range from a few millimeters of up to about ⅛ inch. After application of viscoelastic glue layer 21, constraining layer 17 is placed on viscoelastic glue layer 21. Following that, viscoelastic glue layer 20 is applied to upper surface 22 of constraining layer 17. The thickness of viscoelastic glue layer 20 may be in the range of the thickness used for viscoelastic glue layer 21; however it is not necessary that both of the glue layers be of the same thickness.

Next, layer 15 is placed on the upper surface of the glue layer 20. The assembly is then subjected to dehumidification and drying to allow the panels to dry, typically for 48-hours. Of course, it will be appreciated from FIG. 2 that front panel 2 and rear panel 3 are constructed as indicated above and cut to the appropriate lengths and heights prior to assembly into soundproof assembly 1. In addition to dehumidification, the panels 2 and 3 are subjected to 0.5 to 10 pounds per square inch (psi) pressure during the drying process. And, the panels 2 and 3 may also be heated up to 150° F. for about 24 to 48 hours.

As will be appreciated by reference to FIG. 2, spacers 4, 5, and 6, are placed intermediate to front panel 2 and rear panel 3. Spacers 4, 5, and 6, are secured in place by glue, nails or other mechanical fasteners.

The gap between outer surface 23 of wood layer 15 and outer surface 24 of wood layer 25 is indicated by reference character D1 in FIG. 2. The distance D1 may have any number of values, for example, from 5 mils to 1 inch. If soundproof assembly 1 is to be a door, the typical range for D1 would be from Y4 inch to ½ inch. As shown in FIG. 2, a sheet of mass loaded vinyl indicated by reference character 30 is included in the space between panels 2 and 3. Inclusion of sheet 30 is optional, however. Besides vinyl, a suitable material for sheet 30 may be the same as that used for constraining layer 17 described above.

Rear panel 3 may be constructed similarly to front panel 2, but it is not required that such a construction be utilized. Wood cellulose layers 25 and 26 may have similar thicknesses to the thicknesses of layers 15 and 16 in front panel 2; however, different thicknesses may be utilized. Additionally, each of the wood/cellulose layers in the combination are not necessarily required to have the same thickness, although that is true in the embodiments illustrated. In rear panel 3, a constraining layer 27 may be of a material like any of those layers described above with regard to constraining layer 17, but constraining layer 27 may be made of a different material than constraining layer 17.

After front panel 2 and rear panel 3 have been affixed to spacers 4, 5, and 6, the surround covers 7, 8, 9, and 10, are applied and preferably attached to the peripheral edges of rear panel 2 and rear panel 3 by glue, nails or other mechanical fasteners.

As noted above, the veneer 13 and 14 may optionally be applied to the outer surfaces of front and rear panels 2 and 3 respectively.

Figure 3:
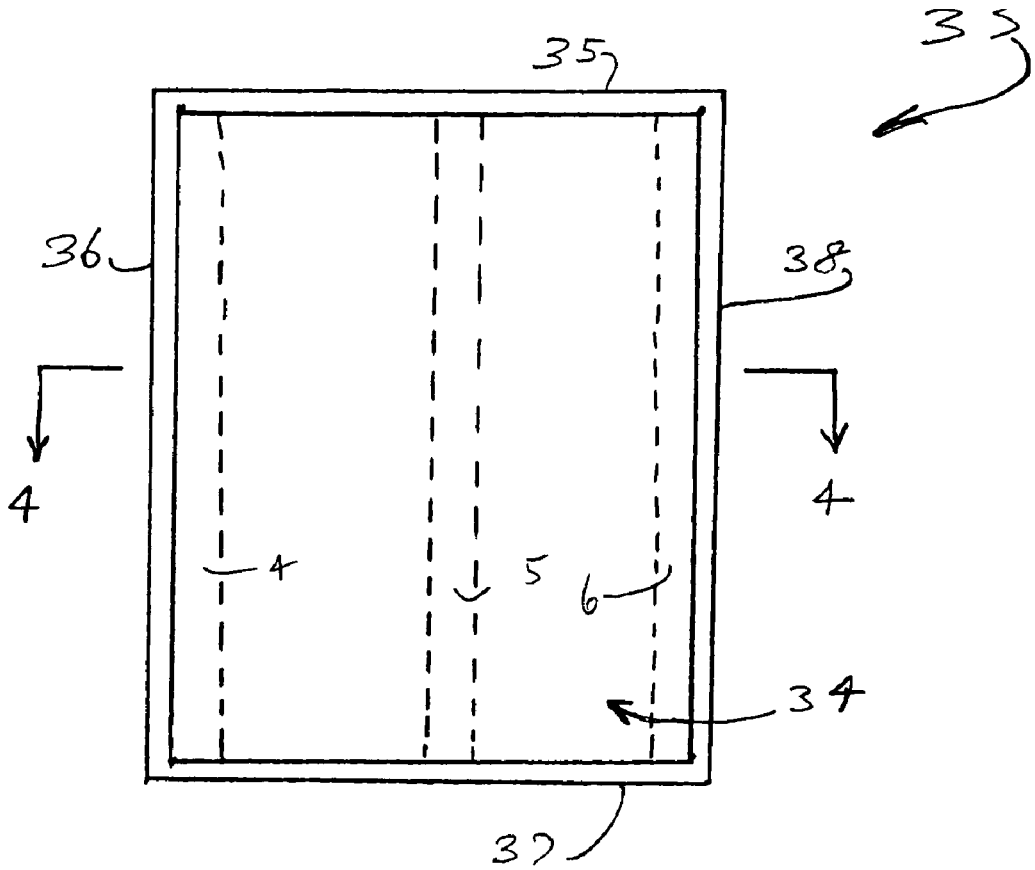
FIG. 3 is a front view of a second embodiment of the present invention.

FIG. 3 illustrates another embodiment of the present invention. In this embodiment, soundproof structure 33 is shown in a front view and includes a front panel 34 and cover sections 35, 36, 37 and 38, which are similar to corresponding cover sections in the embodiment of FIG. 1. In the construction of soundproof assembly 33, spacers are also utilized to separate front panel 34 from the rear panel 3, which has the same construction as the corresponding panel in the embodiment of FIG. 2. Spacers 4, 5, and 6, which may be of the same construction as the spacers used in the embodiment of FIG. 2, are also provided to separate front panel 34 from rear panel 3. Although in this embodiment and that of FIG. 2, three spacers are utilized, it is optional to exclude the center spacer 5, provided that sufficient rigidity is achieved by using only the spacers 4 and 6, which are positioned, at the outer edges of soundproof assembly 33.

Figure 4:
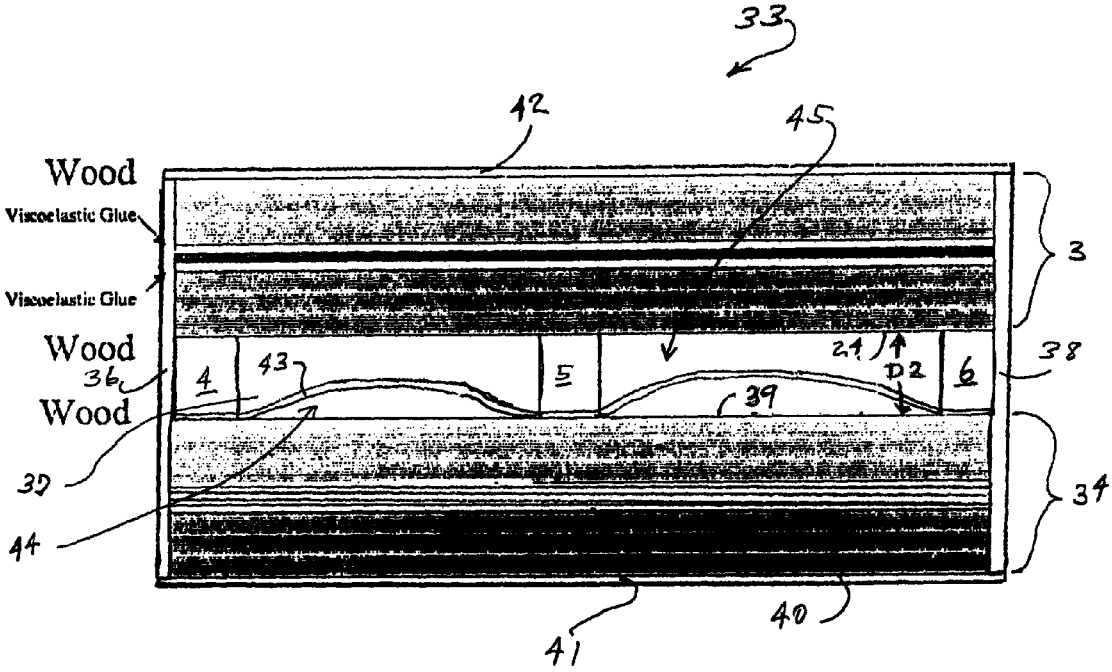
FIG. 4 is a cross-sectional view taken along the lines 4-4 of FIG. 3.
Figure 5:
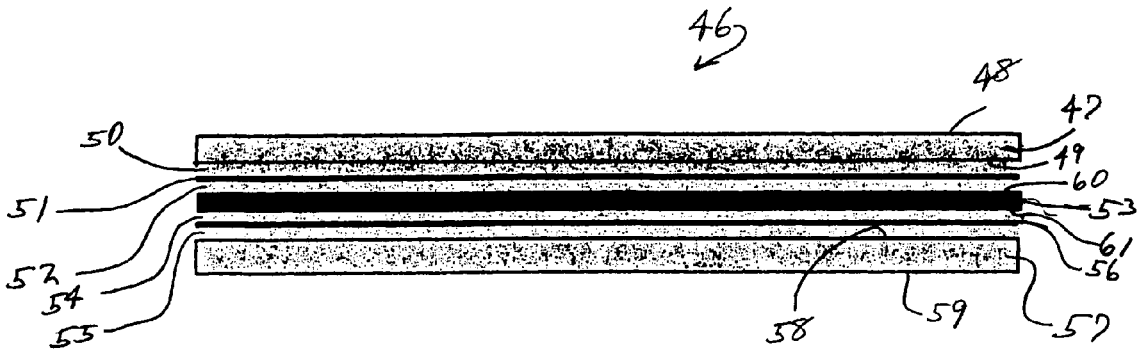
FIG. 5 illustrates an alternate embodiment of a laminar panel which may be utilized in the present invention.

The interior of a soundproof assembly 33 will be better appreciated by reference to FIG. 4, which is a cross sectional view taken along the lines 4-4 in FIG. 3. As will be appreciated by reference in FIG. 4, the rear panel 3 is constructed in like manner to the rear panel 3 in the embodiment of FIG. 2. However, in soundproof assembly 33, the front panel of 34 is constructed of a solid piece of wood/cellulose material indicated in FIG. 4 by reference character 34. Front panel 34 may be for example, ⅝ inch thick and constructed of a cellulose or wood material. Other suitable materials include for example, ceramic, plastic, composite material or metal. The distance D2 between the inner surface 39 of front panel 34 and the inner surface 24 of rear panel 3 may be for example the same distance as D1 in the embodiment of FIGS. 1 and 2. In this embodiment, spacers 4, 5, and 6 are secured to the associated panels 3 and 34 utilizing the same construction technique as that utilized in the embodiment of FIG. 2. A sheet of mass loaded vinyl indicated by reference character 43 is included in air gap enclosures 44 and 45. Sheet 43 may be of the same type of material as described above with regard to sheet 30. As shown in FIG. 4, the ends and the center of sheet 43 are secured in place by spacers 4, 5 and 6, which is the same technique used for sheet 30 in the embodiment of FIG. 2. If soundproof assembly 33 is utilized as a door, for example, the outer periphery is sealed by cover sections 35, 36, 37, and 38.

Front panel 34 in soundproof assembly 33 may be constructed by using, for example, a solid wood or cellulose material or alternatively a plywood layer or one of the alternative materials noted above. The thickness from surface 39 to surface 40 may be for example, ⅝ inch. Another thickness may of course, be utilized, with a greater thickness providing additional improvement in STC. Soundproof assembly 33 may also include the veneers 41 and 42 if it is desirable to provide a more aesthetically pleasing appearance to soundproof assembly 33. The thickness of veneer layers 41 and 42 is a matter of design choice.

FIG. 5 illustrates an alternative laminar panel 46, which may be utilized as one or both panels of the soundproof structures as that illustrated in FIGS. 1, 2, 3, and 4. Laminar panel 46 includes a first outer layer 47, which may be constructed of a cellulose/wood material having a thickness in the range from about 100 mils to 2 inches as measured from outer surface 48 to inner surface 49. Alternatively, outer layer 47 may be a layer of metal, ceramic, fiberglass, a composite material including fiberglass, Kevlar or carbon fiber, or a petroleum-based synthetic material such as vinyl, plastic composite, or rubber.

In this embodiment, glue layer 50 is applied to surface 49 and thereafter a constraining layer 51 is placed on the surface of glue layer 50, which is opposite to surface 49 of first outer layer 47. Constraining layer 51 may be any of the above described constraining layers discussed in the embodiments of FIG. 1, 2, 3, or 4. Glue layer 52 is applied to surface 60 of pine laminar sheet 53, which is of a type commonly used in plywood. Pine laminar sheet 53 may have a thickness of from about 100 mils to about 2 inches; however, it may also be medium density fiberboard ("MDF") or other wood types. Alternatively, in place of pine laminar sheet 53, any of the following may be used: a layer of metal; a layer of ceramic material; a layer of solid petroleum based material such as vinyl, plastic composite or rubber; or a layer of composite material such as fiberglass, Kevlar or carbon fiber.

Next, glue layers 54 and 55 are provided on opposite sides of a second constraining layer 56. Glue layers 54 and 55 may be of the type described above with regard to the embodiments of FIGS. 1, 2, 3, and 4. The structure is completed by the application of second outer layer 57, which may be, for example, of the same type of material utilized in first outer layer 47. The thickness of second outer layer 57, as measured from inner surface 58 and outer surface 59, may be for example, in the range from about 100 mils to 2 inches. Second outer layer 57 may alternatively be any one of the alternative materials described above for first outer layer 47.

In constructing laminar panel 46, typically glue layer 50 is rolled onto surface 49 of first outer layer 47, and glue layer 52 is rolled onto surface 60 of pine laminar sheet 53. Glue layer 54 is applied by rolling it onto surface 61 of pine laminar sheet 53. Glue layer 55 is applied also by roller or another suitable technique to surface 58 of second outer layer 57. Constraining layer 51 is then sandwiched between the surfaces of glue layers 50 and 52, and constraining layer 56 is placed intermediate to glue layers 54 and 55 and the entire structure is then subjected to a compression force of about 1 pound per square inch. When a suitable pressure is described prescribed, the compressive force may be applied for a length of time such as from about 24 to 48 hours. The entire structure then becomes a laminar panel suitable for use in a soundproof structure.

Figure 6:
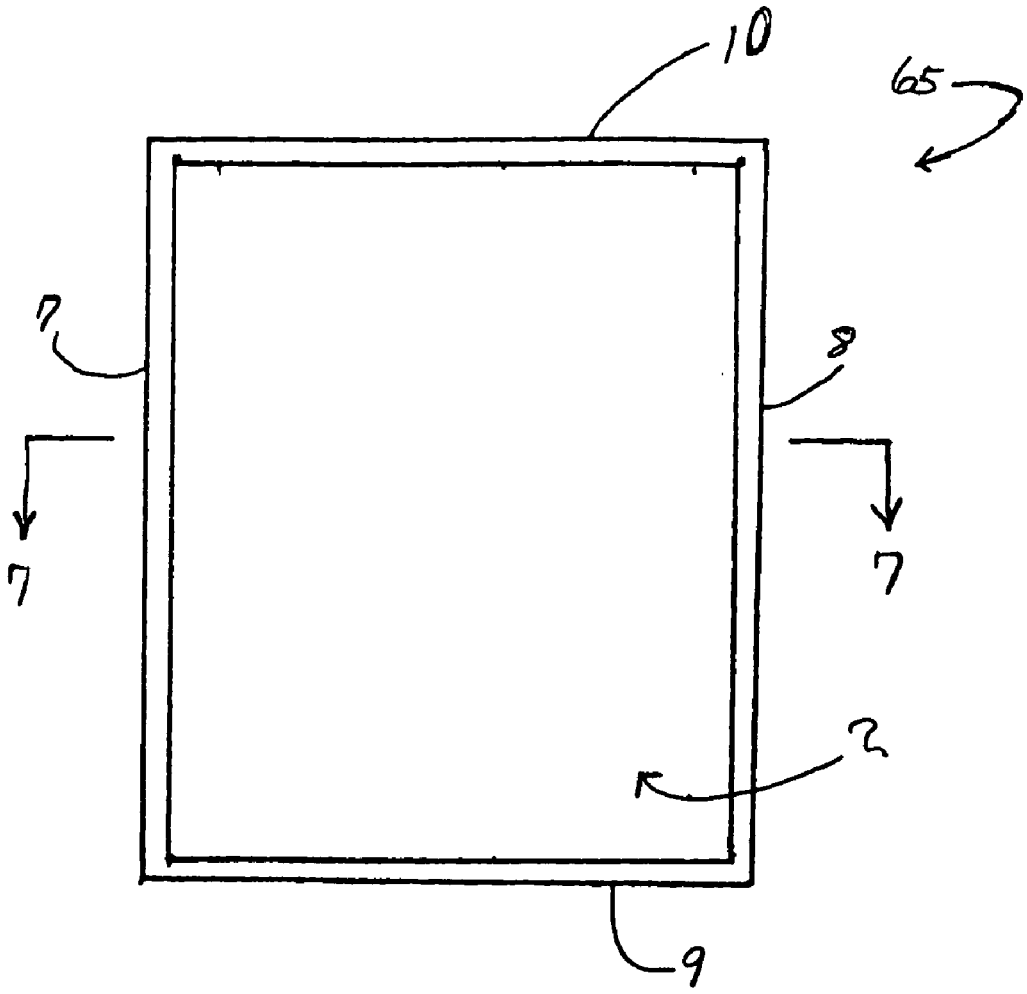
FIG. 6 is a front view of a soundproof assembly in accordance with an embodiment of the invention.
Figure 7:
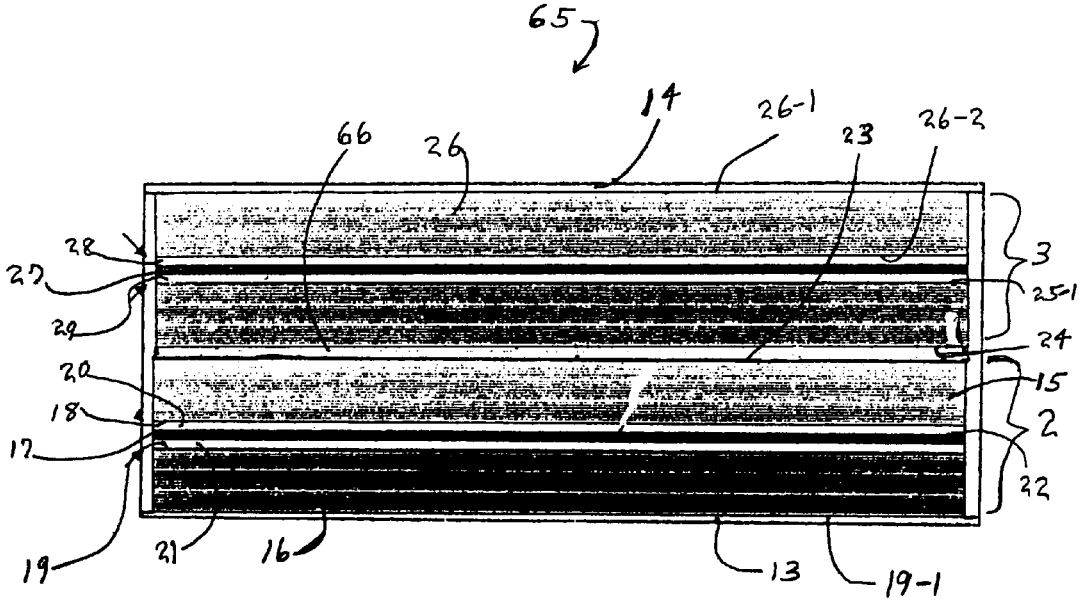
FIG. 7 is a cross-sectional view taken along the lines 7-7 of FIG. 6.

Referring to FIG. 6, soundproof assembly 65 is illustrated in a front view. A number of the elements in soundproof assembly 65 are also utilized in soundproof assembly 1 illustrated in FIGS. 1 and 2, and accordingly common reference characters are utilized in FIG. 6. In soundproof assembly 65, front panel 2 and rear panel 3 which are utilized in soundproof assembly 1 are directly connected utilizing a glue layer rather than the spacer construction which is utilized in soundproof assembly 1. More particularly, referring to FIG. 7, which is a cross-sectional view taken along lines 7-7 of FIG. 6, front panel 2 and rear panel 3 are secured to each other by having glue layer 66 interposed between their respective inner surfaces 24 and 23. Glue layer 66 may be any generally available construction adhesive or alternatively glue layer 66 may be a viscoelastic glue such as viscoelastic glue 28 described above in connection with the description of FIGS. 1 and 2. The thickness and the application techniques may be the same as described above in connection with, for example, glue layer 28 (FIG. 2). As will be appreciated by reference to FIG. 7, the elimination of the air gaps used in the soundproof assembly of FIG. 1 provides a more compact structure.

Figure 8:
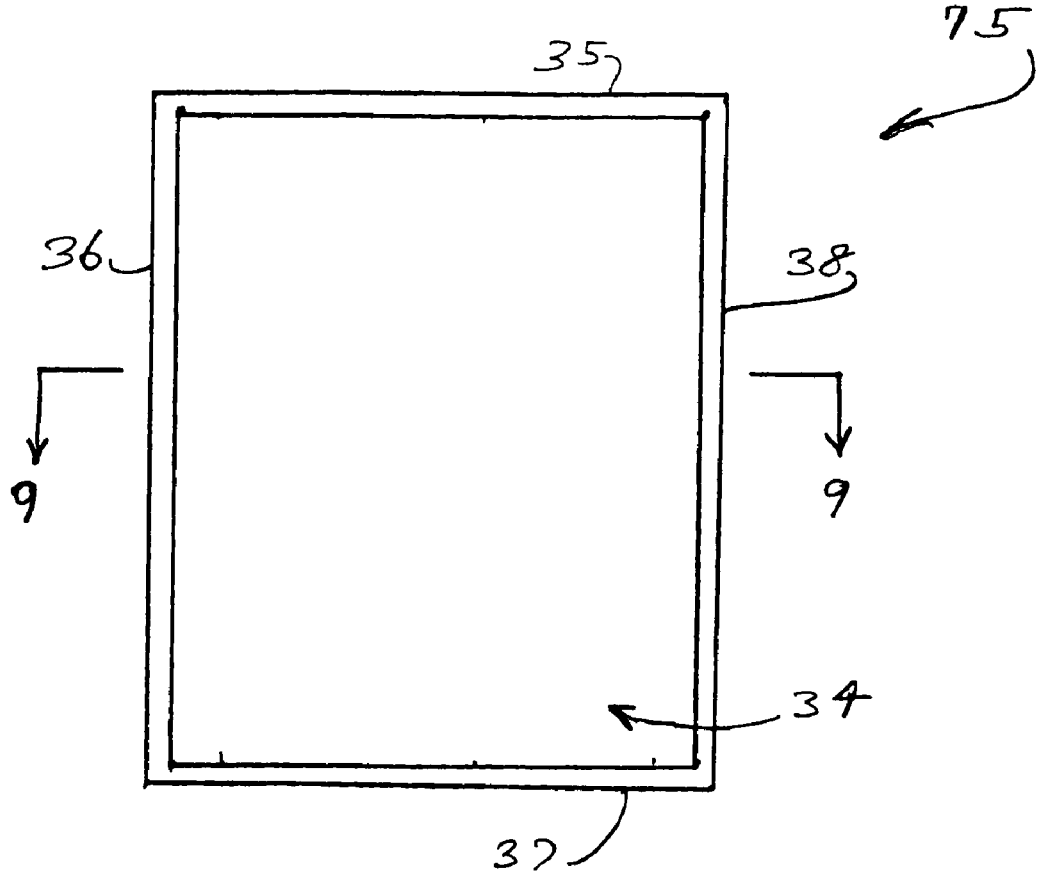
FIG. 8 is a front view of a further embodiment of the present invention.
Figure 9:
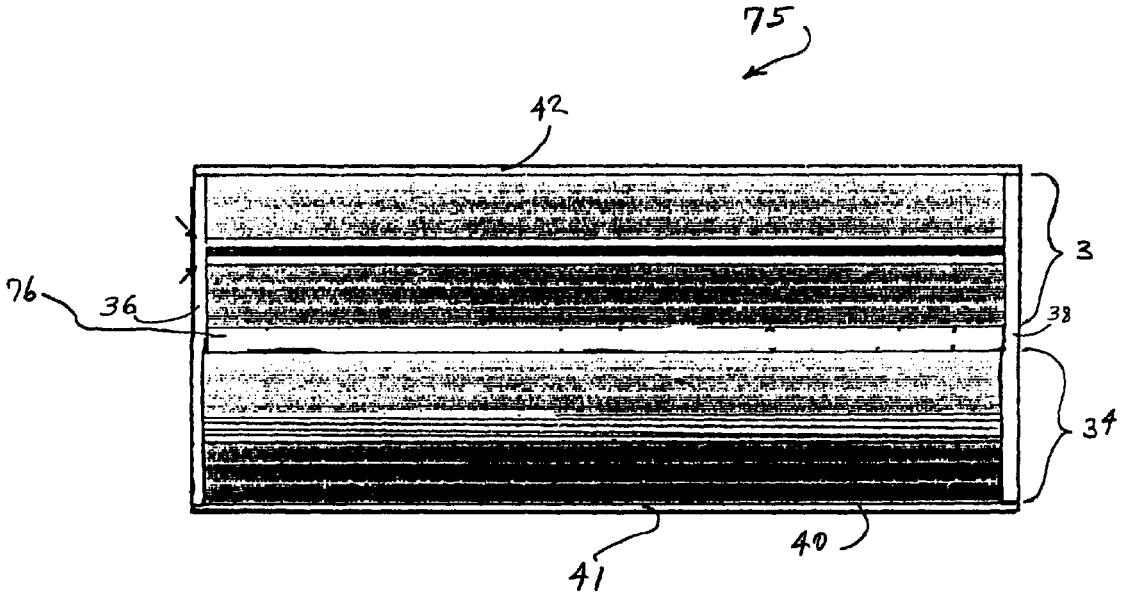
FIG. 9 is a cross-sectional view taken along the lines 9-9 of FIG. 8.

In an alternate embodiment of the present invention soundproof assembly 75 is provided, this assembly being illustrated in FIGS. 8 and 9. Because soundproof assembly 75 utilizes a number of common structural elements found in soundproof assembly 33 of FIGS. 3 and 4, common reference characters are utilized in connection with the two soundproof assemblies. In a fashion similar to soundproof assembly 65 described above, the front and rear panels are connected by a glue layer 76 rather than being spaced apart with spacers as employed in soundproof assembly 33. As will be appreciated by reference to FIG. 9, soundproof assembly 75 utilizes front panel 34 and rear panel 3 which are constructed as illustrated in FIG. 4 and described above in connection with that figure. Accordingly, additional explanation of the construction of the two panels is not required here. Glue layer 76 may be, as described above in connection with soundproof assembly 65, any commonly available construction adhesive or alternatively viscoelastic glue such as viscoelastic layer 28 described in connection with the embodiment illustrated in FIG. 2.

Figure 10:
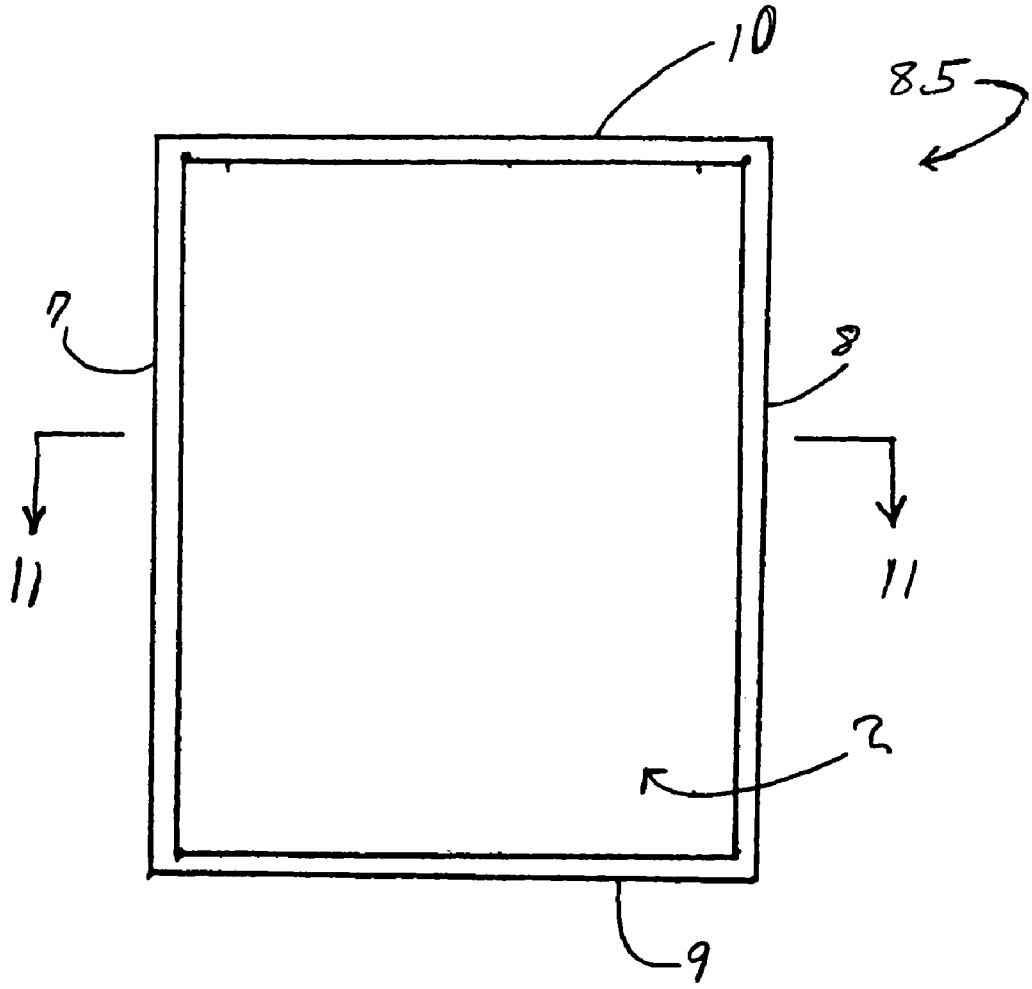
FIG. 10 is a front view of a further embodiment of the present invention.
Figure 11:
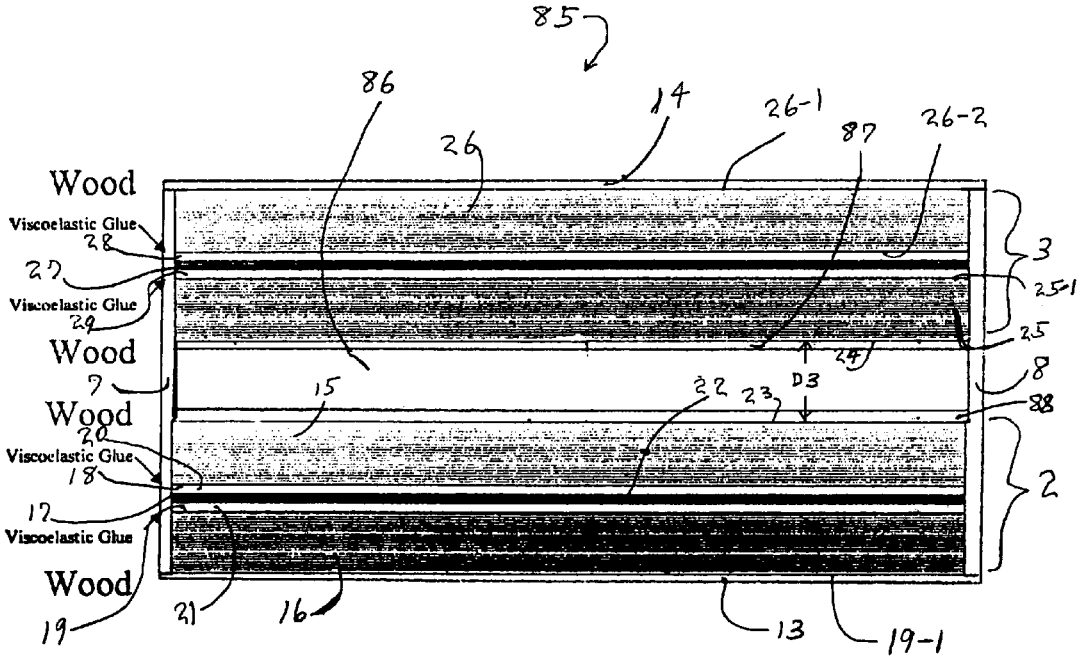
FIG. 11 is a cross-sectional view taken along lines 11-11 of FIG. 10.

Turning to FIGS. 10 and 11, soundproof assembly 85 is illustrated. In this embodiment, front and rear panels, 2 and 3 respectively, are constructed as described above in connection with, for example, FIG. 2 and soundproof assembly 1. Like reference characters are utilized in FIGS. 10 and 11 for structures which have been previously shown and described in connection with soundproof assembly 1.

As illustrated in FIG. 11, interior layer of material 86 is interposed between the respective interior surfaces of front panel 2 and rear panel 3. In the embodiment of soundproof assembly 85 illustrated in FIGS. 10 and 11, interior layer 86 is a wood/cellulose based layer. However, no particular material is required for layer 86, nor is any particular thickness necessary. Layer 86 may alternatively be various types of materials including, such as, for example, metal, a solid petroleum-based synthetic material such as vinyl, plastic composites, rubber, ceramic composite, or fiberglass. Interior layer 86 may be constructed as a solid sheet of material or may alternatively include apertures. For example, interior layer 86 may be constructed as a honeycomb structure or a planar sheet of material with holes through the sheet. Material for a honeycomb structure may be, for example, aluminum. Additionally, acoustically absorptive material such as fiberglass, cellulose insulation, mineral wool, foam or a granular material may be included in the apertures. Front panel 2 and rear panel 3 are secured to interior layer 86 by glue layers 87 and 88. These glue layers may be composed of the same materials as described above in connection with the soundproof assemblies 65 and 75. In the embodiment of FIG. 11, interior layer 86 is coextensive in its height and width with front and rear panels 2 and 3 respectively. This is of course a design choice and interior layer 86 could be made to only partially fill the space between the inner surfaces of panels 2 and 3.

Figure 12:
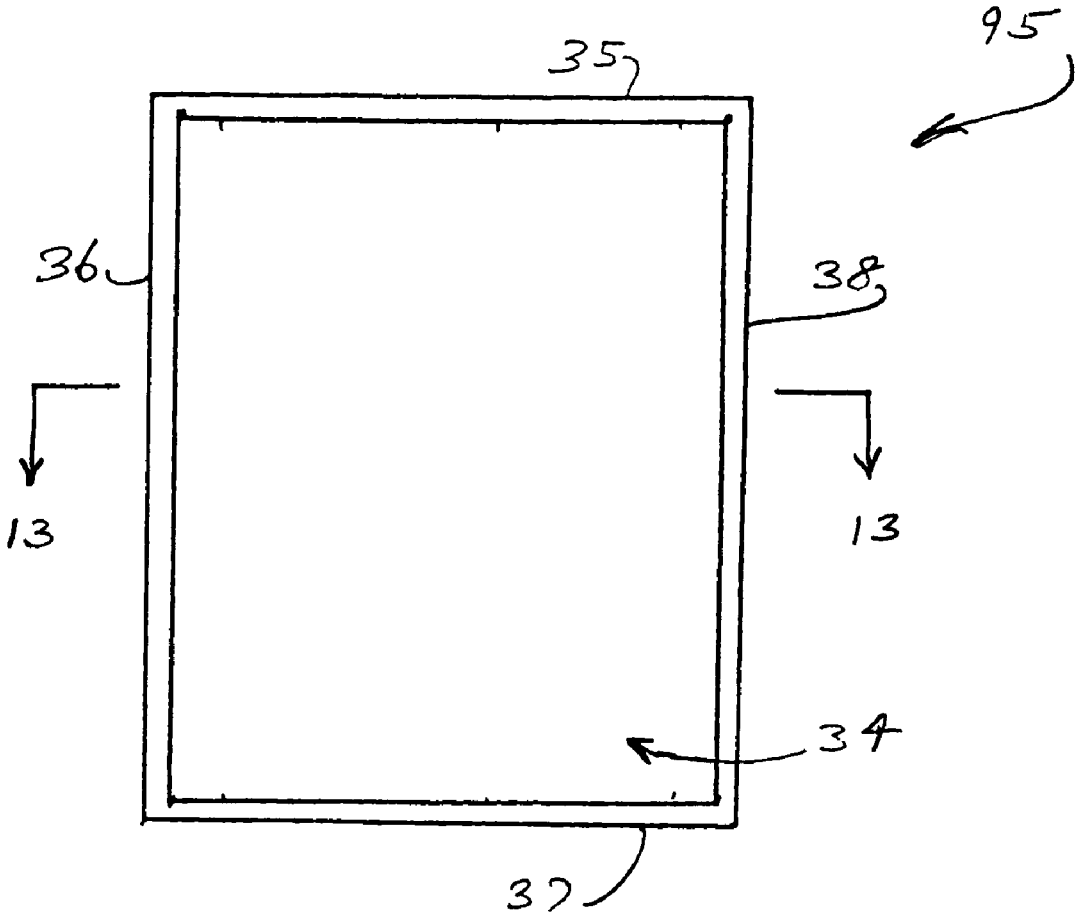
FIG. 12 is a front view of yet another embodiment of the present invention.
Figure 13:
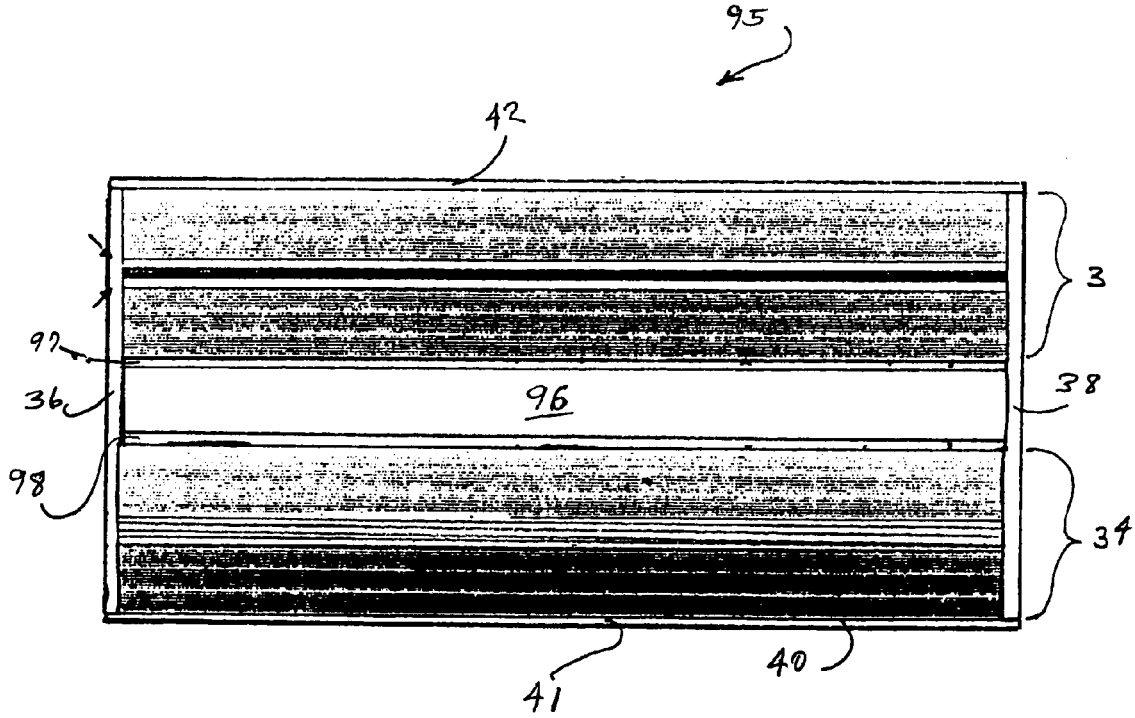
FIG. 13 is a cross-sectional view taken along the lines 13-13 of FIG. 12.

Turning to FIGS. 12 and 13, another embodiment of the invention is disclosed. Soundproof assembly 95 utilizes front panel 34 and rear laminar panel 3 which have been amply described above in connection with the prior embodiments. In the soundproof assembly 95, interior layer of material 96 is spaced between the respective inner surfaces of front panel 34 and rear panel 3. The composition of interior layer 96 may be selected to be the same as that used for interior layer 86 in the embodiment illustrated in FIGS. 10 and 11. The structure of interior layer 96 may be any of those described above in connection with interior layer 86 of soundproof assembly 85. Front panel 34 and rear panel 3 are secured to interior layer 96 utilizing adhesive layers 97 and 98. The composition of these adhesive layers may be the same as adhesive layers 87 and 88 described above in connection with soundproof assembly 85 illustrated in FIGS. 10 and 11.

What is claimed is:

1. A soundproof assembly comprising:

a first panel;

a second panel; and at least one spacer interposed between the first and second panels to provide an air gap between adjacent sides of the first and second panels, wherein at least one of the first and second panels comprise a laminar structure wherein the laminar structure comprises two external layers of material, at least one internal constraining layer and two or more internal layers of a viscoelastic glue separated by the at least one internal constraining layer; and further wherein said internal constraining layer has a Young Modulus of 10 Giga Pascals or greater and further wherein said internal constraining layer has a thickness between 0.013 inch and 0.14 inch.

2. The soundproof assembly of claim 1, wherein each of the first and the second panels comprises a laminar structure.

3. The soundproof assembly according to claim 1, further comprising acoustically absorptive material positioned in a portion of the air gap.

4. The soundproof assembly according to claim 3, wherein the acoustically absorptive material comprises a material selected from the group consisting of fiberglass, cellulose, mineral wool, foam and a granular material.

5. The soundproof assembly of claim 1, wherein the at least one constraining layer comprises metal.

6. The soundproof assembly of claim 5, wherein at least one constraining layer comprises a sheet metal layer of selected thickness.

7. The soundproof assembly of claim 6, wherein the sheet metal layer comprises galvanized steel.

8. The soundproof assembly according to claim 1, wherein the at least one constraining layer comprises a layer of a ceramic material.

9. The soundproof assembly according to claim 1, wherein the at least one internal constraining layer comprises a composite material.

10. The soundproof assembly according to claim 9, wherein the composite material comprises fiberglass, carbon fiber or Kevlar.

11. The soundproof assembly according to claim 1, wherein at least one of the external layers comprises a material selected from the group consisting of wood, a cellulose based material, metal, ceramic, a composite material and fiberglass.

12. The soundproof assembly of claim 2, wherein the first and second laminar panels each comprise two external layers of material, at least one internal constraining layer and two or more internal layers of a viscoelastic glue separated by the at least one internal constraining layer.

13. The soundproof assembly according to claim 12, wherein at least one of the external layers comprises a material selected from the group consisting of wood, a cellulose based material, metal, ceramic, a composite material, and fiberglass.

14. The soundproof assembly of claim 1, further comprising a layer of material affixed around a perimeter of the first and second panels.

15. The soundproof assembly of claim 1, wherein the at least one internal constraining layer comprises at least one material selected from the group consisting of metal, ceramic, a solid petroleum-based synthetic material such as vinyl, plastic composite, or rubber, and a composite material.

16. A method of forming a soundproof assembly comprising:

providing a first panel having a laminar structure, the first panel having first and second exterior surfaces, said first panel comprising two external layers of material, at least one internal constraining layer and two or more internal layers of a viscoelastic glue separated by the at least one internal constraining layer;

providing a second panel having first and second exterior surfaces;

providing a spacer structure having first and second surfaces;

securing the first surface of the spacer structure to the first exterior surface of the first panel; and securing one of the first and second exterior surfaces of the second panel to the second surface of the spacer structure; and further wherein said internal constraining layer has a Young Modulus of 10 Giga Pascals or greater and further wherein said internal constraining layer has a thickness between 0.013 inch and 0.14 inch.

17. The method according to claim 16, wherein providing the second panel comprises: providing a panel with a laminar structure.

18. The method of claim 16, wherein providing the first panel having a laminar structure comprises:

providing a first layer of material, the first layer having an interior and an exterior surface;

applying a first layer of a viscoelastic glue to the interior surface of the first layer of material;

providing a constraining layer of material;

providing a second layer of material;

applying a second layer of viscoelastic glue to one surface of the second layer of material;

interposing the constraining layer of material between exposed surfaces of the first and second layers of viscoelastic glues; and pressing the first layer of material, the first layer of viscoelastic glue, the constraining layer, the second layer of viscoelastic glue and the second layer of material for a selected time.

19. The method of claim 18, wherein providing a constraining layer of material comprises providing a layer of metal.

20. The method of claim 19, wherein providing a layer of metal comprises providing a sheet metal layer.

21. The method of claim 20, wherein providing a sheet metal layer comprises providing a layer of galvanized steel.

22. The method of claim 18, wherein providing a constraining layer of material comprises providing a layer of solid petroleum-based synthetic material selected from the group consisting of vinyl, plastic composite, and rubber.

23. The method according to claim 18, wherein providing a constraining layer of material comprises providing a layer of material selected from the group consisting of sheet ceramic, sheet fiberglass, and a sheet of composite material.

24. The method according to claim 18, wherein providing a first layer of material comprises providing a layer of material selected from the group consisting of ceramic, metal, fiberglass, and a composite material.

* * * * *